United States Patent [19]

Streeter

[11] 4,010,532

[45] Mar. 8, 1977

[54] PORTABLE RIVET BREAKING DEVICE

[76] Inventor: Albert G. Streeter, P.O. Box 75, Bassett, Ark. 72313

[22] Filed: May 21, 1976

[21] Appl. No.: 688,910

[52] U.S. Cl. ..... 29/267; 72/457

[51] Int. Cl.[2] ..... B23P 19/04

[58] Field of Search ..... 29/268, 267, 200 D, 29/200 H; 72/457; 225/103

[56] References Cited

UNITED STATES PATENTS

| | | | |
|---|---|---|---|
| 1,299,134 | 4/1919 | Cromptom | 225/103 |
| 3,138,977 | 6/1964 | Aitken | 29/200 B |
| 3,234,634 | 2/1966 | Johnson et al. | 29/200 D |

*Primary Examiner*—James L. Jones, Jr.
*Attorney, Agent, or Firm*—John R. Walker, III

[57] ABSTRACT

A device for use in removing an individual cutting tooth from the reciprocating drive bar of a sickle mower. A substantially U-shaped guide is positioned on the two adjacent guard members of the sickle mower that are located on either side of the individual cutting tooth that is to be removed. A handle is pivotally attached to the guide. A hook member is pivotally attached to the handle at a location above the location where the handle is pivotally attached to the guide. The hook member is positioned so as to grasp a portion of the individual cutting tooth that is to be removed. A strut member is pivotally attached to the handle at a location below the location where the handle is pivotally attached to the guide. The strut member is positioned so as to engage a portion of the reciprocating drive bar adjacent the individual cutting tooth that is to be removed. When the handle is pivoted downwardly, the hook member will pull against the individual cutting tooth which it is grasping and the strut member will push against the portion of the reciprocating drive bar which it is engaging thereby shearing any rivet holding that individual cutting tooth to the reciprocating drive bar and allowing that individual cutting tooth to be removed from the reciprocating drive bar.

6 Claims, 5 Drawing Figures

FIG. 1
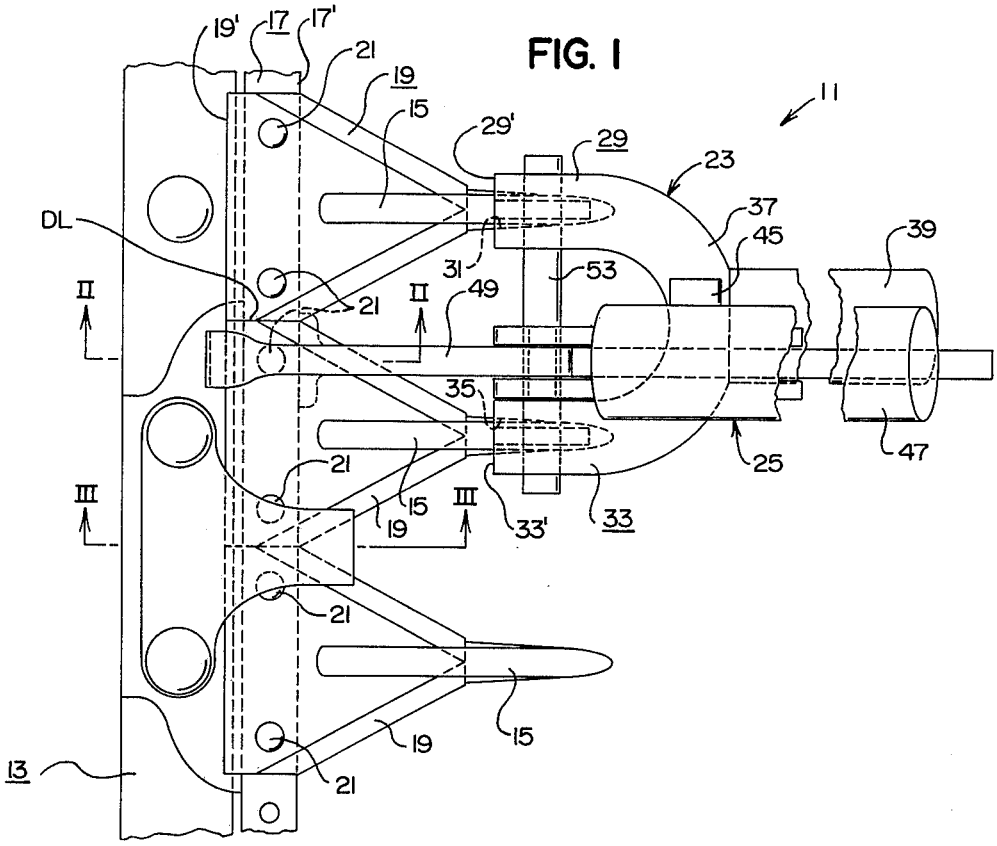
FIG. 2
FIG. 3
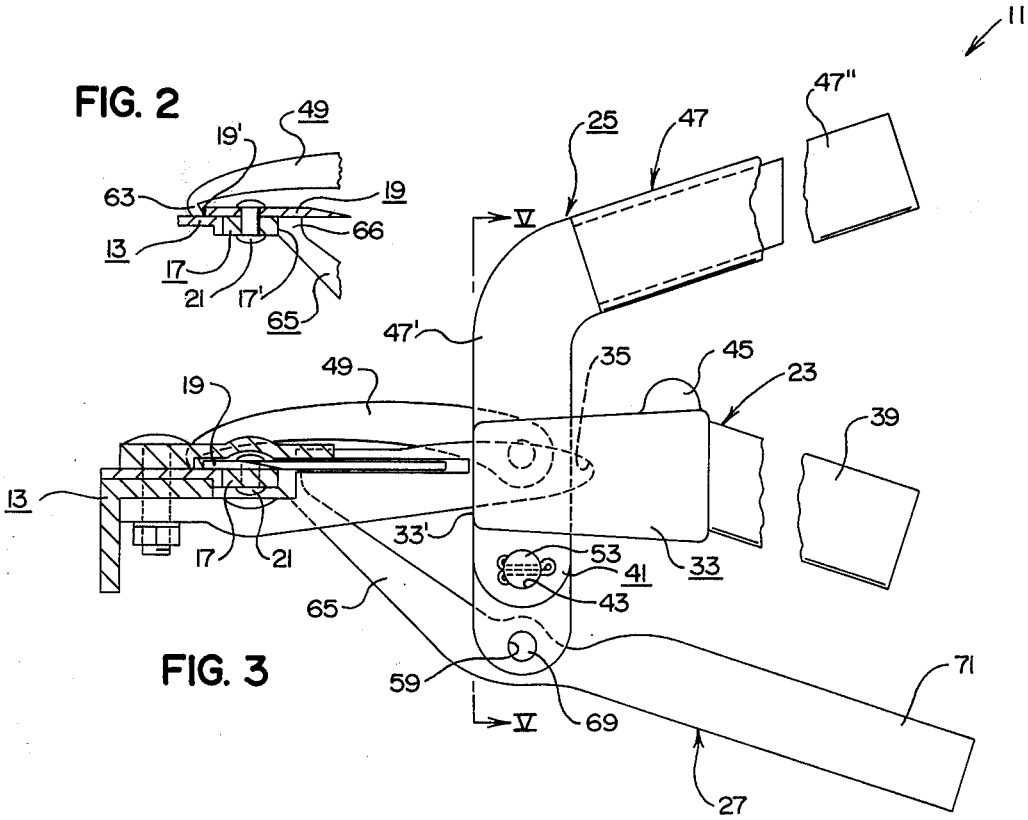

PORTABLE RIVET BREAKING DEVICE

BACKGROUND OF THE INVENTION

1 Field of the Invention

This invention relates generally to tools for removing rivets and the like, and more specifically to portable tools for removing rivets which hold the cutting teeth to the reciprocating drive bar in a sickle mower.

2. Description of the Prior Art

Heretofore, various tools have been developed for removing rivets and the like. See, for example, Crompton, U.S. Pat. No. 1,299,134; Johnson et al, U.S. Pat. No. 1,808,041; Aitken, U.S. Pat. No. 3,138,977 and Johnson et al U.S. Pat. No. 3,234,634. None of the above patents disclose or suggest the present invention.

Each cutting tooth of a typical sickle mower is usually individually mounted on the reciprocating drive bar of the sickle mower by one or more rivets. Often, these individual cutting teeth become broken, bent, blunt or the like and must be replaced. To replace such cutting teeth, the rivets holding each individual cutting tooth to the reciprocating drive bar of the sickle mower must be removed. Although various tools have been developed to remove such rivets as evidenced by the Crompton U.S. Pat. No. 1,299,134, Johnson U.S. Pat. No. 1,808,041, and Johnson U.S. Pat. No. 3,234,634, the most common way of removing such rivets is with a hammer and chisel. This is because all the prior tools have been disadvantageous for one reason or another. Crompton U.S. Pat. No. 1,299,134 and Johnson U.S. Pat. No. 1,808,041 are disadvantageous since they do not easily allow the rivets holding the cutting teeth to the reciprocating drive bar of a sickle mower to be broken while the sickle mower is at the work site. That is, Crompton U.S. Pat. No. 1,299,134 and Johnson U.S. Pat. No. 1,808,041 are designed for use where the sickle blade (i.e., the individual cutting teeth and the reciprocating drive bar) are removed from the remainder of the sickle mower and brought into a workshop or the like thereby resulting in the sickle mower being out of service for extended periods. While Johnson U.S. Pat. No. 3,234,634 allows such rivets to be removed while the sickle mower is at the work site and while the sickle blade is attached to the remainder of the sickle mower, it is disadvantageous in that it is slow working and the rivet engaging end 39 of the punch element 29 thereof is easily broken if not properly aligned with the rivet to be removed.

SUMMARY OF THE INVENTION

The present invention is directed towards overcoming the problems and disadvantages of prior devices for removing the rivets holding the individual cutting teeth of a sickle mower to the reciprocating drive bar thereof. One object of the present invention is to provide a portable rivet breaking device which can be easily carried to the work site of a sickle mower so that the individual cutting teeth can be easily and quickly removed at the work site. Another object of the present invention is to provide a rivet breaking device which can easily break such rivets without requiring precise alignment of the device relative to the rivets. The portable rivet breaking device of the present invention includes a guide means for allowing the rivet breaking device to be properly positioned on a sickle mower. The guide means includes means for selectively fitting over at least one of the forwardly projecting guard members of the sickle mower that are positioned adjacent each individual cutting tooth. A handle member is pivotally mounted to the guide means. A hook member is pivotally mounted to the handle member at a location above the location where the handle member is pivotally mounted to the guide means. The hook member is adapted to selectively grasp a portion of an individual cutting tooth of a sickle mower. A strut member is pivotally mounted to the handle member at a location below the location where the handle member is pivotally mounted to the guide means. The strut member is adapted to selectively engage a portion of the reciprocating drive bar of a sickle mower substantially adjacent the individual cutting tooth that is grasped by the hook member. Downward movement of the handle member will cause the hook member to apply a pulling force to the individual cutting tooth which is grasping and willl cause the strut member to apply a pushing force to the portion of the reciprocating drive bar of the sickle mower that it is engaging thereby shearing any rivets holding that individual cutting tooth to the reciprocating drive bar of the sickle mower.

BRIEF DESCRIPTION OF THE DRAWINGS

FIG. 1 is a top plan view of the portable rivet breaking device of the present invention shown positioned on a sickle mower.

FIG. 2 is a partially sectional view as taken on line II–II of FIG. 1.

FIG. 3 is a partially sectional view as taken on line III–III of FIG. 1.

DESCRIPTION OF THE PREFERRED EMBODIMENT

Figure 4:
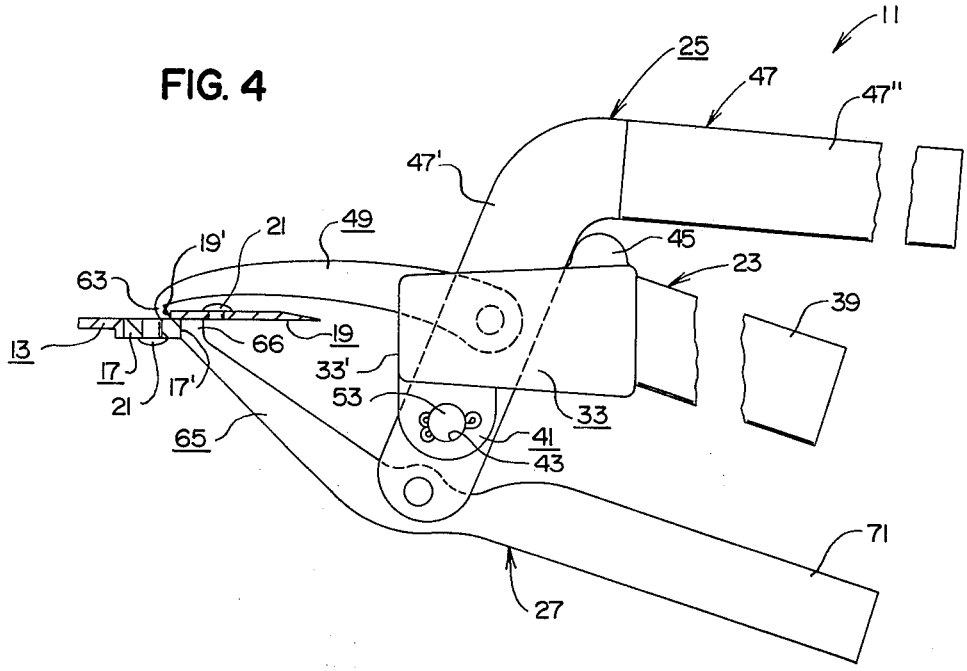
FIG. 4 is a view substantially similar to FIG. 3 with some parts omitted for clarity and with the portable rivet breaking device shown breaking a rivet holding an individidual cutting tooth of the sickle mower to the reciprocating drive bar thereof.

The portable rivet breaking device 11 of the present invention is for use with a typical sickle mower of the type that includes a base member 13 having a plurality of forwardly projecting guard members 15 fixedly mounted thereon and that includes a reciprocating drive bar 17 having a plurality of cutting teeth 19 individually attached thereto by way of rivets 21 (see, in general, FIGS. 1, 2, 3, and 4). The base member 13 is attached to the remainder of the sickle mower (not shown) to allow the sickle mower to be used to cut grass or the like in a manner well known to those skilled in the art. The actual cutting of the grass or the like is accomplished by the coaction of the cutting teeth 19 and the guard members 15. That is, the guard members 15 are constructed in a manner well known to those skilled in the art so as to coact with the cutting teeth 19 in a scissors-like manner to cut the grass or the like when the cutting teeth 19 reciprocate back and forth relative to the guard members 15. It should be noted that the sickle mower is provided with substantially an equal number of guard members 15 and cutting teeth 19 so that each cutting tooth 19 has at least one guard member 15 to coact with to cut the grass of the like.

The rivet breaking device 11 includes, in general, a guide means 23, a first shear means 25, and a second shear means 27. The guide means 23 of the rivet breaking device 11 allows the rivet breaking device 11 to be properly positioned on a sickle mower. More specifically, the guide means 23 includes means for selectively fitting over at least one of the forwardly projecting guard members 15 of a sickle mower. Preferably, the guide means 23 includes a first leg member 29 having a forward end 29' with an inwardly directed aperture 31 extending substantially along the longitudinal axis thereof and having a shape that is substantially the inverse of a typical guard member 15 for allowing the first leg member 29 to fit over one of the forwardly projecting guard members 15 of a sickle mower. The guide means 23 preferably includes a second leg member 33 having a forward end 33' with an inwardly directed aperture 35 extending substantially along the longitudinal axis thereof and having a shape that is substantially the inverse of a typical guard member 15 for allowing the second leg member 33 to fit over one of the guard members 15 of a sickle mower. The first and second leg members 29 and 33 are preferably spaced apart from one another a distance substantially equal to the spaced apart distance between two adjacent forwardly projecting guard members 15 of a sickle mower for allowing the guide means 23 to be positioned on two adjacent guard members 15 of a sickle mower. The guide means 23 may include a bridge member 37 for fixedly joining the first and second leg members 29, 33 together. The bridge member 37 may be joined to the first and second leg members 29, 33 together. The bridge member 37 may be joined to the first and second leg members 29, 33 adjacent the rearward end thereof so that the first and second leg members 29, 33 and the bridge member 37 form a substantially U-shaped body member. The guide means 23 may include a handle member 39 fixedly attached to the bridge member 37 thereof and extending rearwardly therefrom for allowing the guide means 23 to be easily positioned upon a sickle mower. A lug 41 is preferably provided on the underneath side of each leg member 29, 33 substantially adjacent the forward ends 29', 33' thereof for reasons which will hereinafter become apparent. Each lug 41 is provided with an aperture 43 transverse to the longitudinal axis of each leg member 29, 33. A boss 45 is preferably provided on the upper side of the bridge member 37 for reasons which will hereinafter become apparent.

Figure 5:
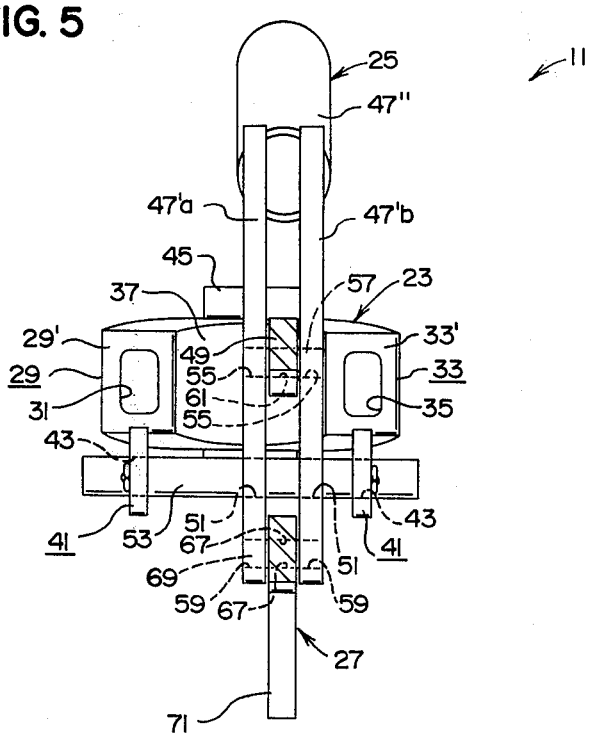
FIG. 5 is a partially sectional view as taken on line V–V of FIG. 3 with some parts removed for clarity.

The first shear means 25 of the rivet breaking device 11 includes a handle member 47 pivotally mounted to the guide means 23 and includes a hook member 49 pivotally mounted to the handle member 47 at a location above the location where the handle member 47 is pivotally mounted to the guide means 23. The hook member 49 is adapted to selectively grasp a portion of an individual cutting tooth 19 of a sickle mower in a manner and for reasons which will hereinafter become apparent. The handle member 47 is preferably substantially L-shaped. That is, the handle member 47 includes a first portion 47' that is pivotally attached to the guide means 23 and includes a second portion 47'' that is preferably fixedly attached to the upper end of the first portion 47' at a substantially right angle so that the handle member 47 becomes substantially L-shaped as shown in FIGS. 3 and 4. To reduce the weight of the handle member 47, the first portion 47' thereof may be constructed of two spaced apart metal plates **47'*a*, 47'*b* (see FIG. 5) and the second porition 47'' thereof may be constructed of a length of hollow metal piping or the like with the ends of the spaced-apart metal plates 47'*a*, 47'*b* affixed thereto as by welding or the like. It should be noted that spacers (not shown) or the like may be provided between the two spaced apart metal plates 47'*a*, 47'*b* in a manner apparent to those skilled in the art. A first set of apertures 51 are provided through the plates 47'*a*, 47'*b* of the first portion 47' of the handle member 47 to allow the handle member 47 to be pivotally mounted to the guide means 23 by way of a pivot rod 53 which passes through the first set of apertures 51 and the apertures 43 in the lugs 41 of the guide means 23 (see FIG. 5). A second set of apertures 55 are provided through the metal plates 47'*a*, 47'*b*, above the location of the first set of apertures 51 for allowing the hook member 49 to be pivotally mounted to the handle member 47 by way of a pivot rod 57 (see FIG. 5). A third set of apertures 59 are provided through the metal plates 47'*a*, 47'*b* below the location of the first set of apertures 51** for reasons which will hereinafter become apparent.

The hook member 49 of the first shear means 25 preferably consists of an elongated metal member having an aperture 61 through one end thereof for allowing the hook member 49 to be pivotally attached to the handle member 47 by way of the pivot rod 57. The end of the hook member 49 opposite the aperture 61 is provided with a gaff-like portion 63 for selectively grasping a portion of an individual cutting tooth 19 of a sickle mower.

The second shear means 27 of the rivet breaking device 11 includes a strut member 65 for selectively engaging a portion of the reciprocating drive bar 17 of a sickle mower. The strut member 65 includes a head portion 66. An aperture 67 is provided through the strut member 65 for allowing the strut member 65 to be pivotally mounted to the handle member 47 by way of a pivot rod 69 which passes through the aperture 67 and the third set of apertures 59 in the metal plates **47'*a*, 47'*b* of the first portion 47' of the handle member 47 of the first shear means 25. The second shear means 27 may include a counterweight member 71 fixedly attached to the rearward end of the strut member 65 for reasons which willl hereinafter become apparent. The strut member 65 and counterweight member 71** are preferably integrally formed as a one-piece unit from a metal material such as steel or the like in the shape substantially as shown in the drawings.

The operation of the rivet breaking device 11 of the present invention is quite simple. The first step is to grasp the handle member 39 of the guide means 23 and manually position the first and second leg member 29, 33 of the guide means 23 on a sickle mower with two adjacent forwardly projecting guard members 15 of the sickle mower received in the apertures 31, 33 in the forward ends 29', 33' of the first and second leg members 29, 33 as far as possible. The first shear means 25 may then require manual adjustment to insure that the gaff-like portion 63 of the hook member 49 thereof properly grasps the rearward edge 19' of the individual cutting tooth 19 that is to be removed as shown in FIG. 2. Also, the second shear means 27 may require manual adjustment to insure that the head portion 66 of the strut member 65 thereof properly engages the forward edge 17' of the reciprocating drive bar 17 of the sickle mower as shown in FIG. 2. It should be noted that the gaff-like portion 63 of the hook member 49 is preferably positioned substantially centered behind the rivet 21 that is to be sheared and that the head portion 66 of the strut member 65 of the second shear means 27 is preferably positioned on the forward edge 17' of the reciprocating drive bar 17 at a location substantially beneath the dividing line DL between the cutting tooth 19 that is to be removed and an adjacent cutting tooth 19 (see FIG. 1). It should be noted that the handle member 47 of the first shear means 25 is capable of being moved along the longitudinal axis of the pivot rod 53 thereby allowing the hook member 49 and the strut member 65 to be easily adjusted relative to the cutting tooth 19 that is to be removed. Also, it should be noted that the reciprocating drive bar 17 may be moved one way or the other to adjust the location of the cutting tooth 19 that is to be removed relative to the rivet breaking device 11 when the rivet breaking device 11 is positioned on two adjacent guard members 15 of a sickle mower. Pressure is then applied to the handle member 47 of the first shear means 25 to move the handle member 47 towards the handle member 39 of the guide means thereby causing the hook member 49 to apply a pulling force to the individual cutting tooth 19 that is to be removed while the strut member 65 of the second shear means 27 applies a pushing force to the reciprocating drive bar 17 of the sickle mower substantially adjacent the individual cutting tooth 19 that is to be removed resulting in the rivet 21 holding the individual cutting tooth 19 that is to be removed being sheared as shown in FIG. 4. It should be noted that the counterweight member 71 will hold the strut member 65 adjacent the reciprocating drive bar 17 as force is applied to the handle member 47 of the first shear means 25. The boss 45 acts as a stop to prevent the handle member 47 of the first shear means 25 from causing possible injury to the user of the device 11 when the handle member 47 of the first shear means 25 is forced toward the handle member 39 of the guide means 23. Additionally, it should be noted that when more than one rivet 21 is utilized to hold each individual cutting tooth 19 to the reciprocating drive bar 17, it may be necessary to repeat the above procedure for each of the rivets 21 holding the individual cutting tooth 19 that is to be removed to the reciprocating drive bar 17.

Although the invention has been described and illustrated with respect to a preferred embodiment thereof, it is not to be so limited since changes and modifications may be made therein which are within the full intended scope of the invention.

I claim:

1. A portable rivet breaking device for use with a sickle mower of the type including a base member having a plurality of forwardly projecting guard members fixedly mounted thereon and including a reciprocating drive bar having a plurality of cutting teeth individually riveted thereto, said rivet breaking device comprising:

a. guide means for positioning said rivet breaking device on a sickle mower, said guide means including means for selectively fitting over at least one of the forwardly projecting guard members of the sickle mower;

b. first shear means including a handle member pivotally mounted to said guide means and including a hook member for selectively grasping a portion of an individual cutting tooth of a sickle mower, said hook member being pivotally mounted to said handle member at a location above the location where said handle member is pivotally mounted to said guide means; and c. second shear means including a strut member for selectively engaging a portion of the reciprocating drive bar of a sickle mower, said strut member being pivotally mounted to said handle member of said first shear means at a location below the location where said handle member is pivotally mounted to said guide means whereby downward movement of said handle member will cause said hook member to apply a pulling force to the individual cutting tooth which it is grasping and will cause said strut member to apply a pushing force to the portion of the reciprocating drive bar of the sickle mower that it is engaging thereby shearing any rivet holding that individual cutting tooth to the reciprocating drive bar.

2. The portable rivet breaking device of claim 1 in which said guide means includes first and second leg members joined together at the rearward ends thereof by a bridge member to form a substantially U-shaped body member, said first and second leg members being spaced apart from one another a distance substantially equal to the spaced-apart distance of two adjacent guard members of a sickle mower, each of said first and second leg members having an inwardly directed aperture in the forward end thereof extending along the longitudinal axis thereof for allowing said first and second leg members to be positioned on two adjacent guard members of a sickle mower.

3. The portable rivet breaking device of claim 2 in which said guide means includes a handle member fixedly attached to said bridge member thereof and extending rearwardly therefrom.

4. The portable rivet breaking device of claim 1 in which said second shear means includes a counterweight member fixedly attached to the rearward end of said strut member.

5. The portable rivet breaking device of claim 2 in which said hook member of said first shear means is slidable sidewards relative to said first and second leg members of said guide means for allowing said hook member of said first shear means to be selectively positioned so as to grasp a specific portion of an individual cutting tooth when said first and second leg members of said guide means are positioned on two adjacent guard members of a sickle mower.

6. A portable rivet breaking device for use with a sickle mower of the type including a base member having a plurality of forwardly projecting guard members fixedly mounted thereon and including a reciprocating drive bar slidably supported on the base member and having a plurality of cutting teeth individually riveted thereto, said rivet breaking device comprising:

a. guide means for positioning said rivet breaking device on a sickle mower, said guide means including first and second leg members joined together at the rearward ends thereof by a bridge member to form a substantially U-shaped body member, said first and second leg members being spaced apart from one another a distance substantially equal to the spaced apart distance fo two adjacent guard members of a sickle mower, each of said first and second leg members having an inwardly directed aperture in the forward end thereof extending along the longitudinal axis thereof for allowing said first and second leg members to be positioned on two adjacent guard members of a sickle mower, said guard means including a handle member fixedly attached to said bridge member and extending rearwardly therefrom;

b. first shear means including a handle member pivotally mounted to said guide means and including a hook member for selectively grasping a portion of an individual cutting tooth of a sickle mower, said hook member being pivotally mounted to said handle member at a location above the location which said handle member is pivotally mounted to said guide means, said hook member being slidable sidewards relative to said first and second leg members of said guide means for allowing said hook member to be selectively positioned so as to grasp a specific portion of an individual cutting tooth of a sickle mower when said first and second leg members of said guide means are positioned on two adjacent guard members of a sickle mower; and c. second shear means including a strut member for selectively engaging a portion of the reciprocating drive bar of a sickle mower, said strut member being pivotally mounted to said handle member of said first shear means at a location below the location where said handle member of said first shear means is pivotally mounted to said guide means whereby movement of said handle member of said first shear means toward said handle member of said guard member will cause said hook member of said first shear means to apply a pulling force to the individual cutting tooth which it is grasping and will cause said strut member of said second shear means to apply a pushing force to the portion of the reciprocating drive bar of the sickle mower that it is engaging thereby shearing any rivet holding that individual cutting tooth to the reciprocating drive bar, said second shear means including a counterweight member fixedly attached to the rearward end of said strut member.

* * * * *